US007581556B2

(12) United States Patent
Haslach, Jr. et al.

(10) Patent No.: US 7,581,556 B2
(45) Date of Patent: Sep. 1, 2009

(54) CRUTCH-LIKE MOBILITY ASSIST DEVICE WITH ROTATABLE FOOTER ASSEMBLY

(75) Inventors: Henry W. Haslach, Jr., Greenbelt, MD (US); James R. Borrelli, North Potomac, MD (US)

(73) Assignee: University of Maryland, College Park, MD (US)

( * ) Notice: Subject to any disclaimer, the term of this patent is extended or adjusted under 35 U.S.C. 154(b) by 303 days.

(21) Appl. No.: 11/637,928

(22) Filed: Dec. 13, 2006

(65) Prior Publication Data

US 2007/0144568 A1 Jun. 28, 2007

Related U.S. Application Data

(60) Provisional application No. 60/743,028, filed on Dec. 13, 2005.

(51) Int. Cl.
*A45B 9/04* (2006.01)

(52) U.S. Cl. ..... 135/84; 135/77

(58) Field of Classification Search ..... 135/68, 135/77, 82, 84, 86; 248/188.8, 188.9, 276.1, 248/284.1, 615, 677; 403/11, 52–55, 61, 403/62, 65, 70, 78, 57, 58
See application file for complete search history.

(56) References Cited

U.S. PATENT DOCUMENTS

| | | | | |
|---|---|---|---|---|
| 679,468 | A | 7/1901 | Pratt | |
| 956,438 | A | 4/1910 | Seibert | |
| 994,194 | A | 6/1911 | Pratt | |
| 1,183,008 | A | 5/1916 | Hipwood | |
| 1,348,531 | A | 8/1920 | Amadio | |
| 2,300,726 | A | 11/1942 | Douglas | |
| 2,453,742 | A | 11/1948 | Bowen et al. | |
| 4,141,375 | A | 2/1979 | Tykwinski | |
| 4,291,715 | A | 9/1981 | Monte | |
| 4,440,186 | A | 4/1984 | Lottner | |
| 4,510,957 | A | 4/1985 | Frank | |
| 4,561,618 | A * | 12/1985 | Zeigler | 248/166 |
| 4,708,154 | A | 11/1987 | Edwards | |
| 4,947,882 | A | 8/1990 | Levasseur | |
| 5,113,887 | A | 5/1992 | Herman, Jr. | |
| 5,217,033 | A | 6/1993 | Herman, Jr. | |
| 5,307,828 | A | 5/1994 | Gardner et al. | |
| 5,318,058 | A | 6/1994 | Zimmerman | |
| 5,862,824 | A | 1/1999 | Herman | |

(Continued)

*Primary Examiner*—David Dunn
*Assistant Examiner*—Noah Chandler Hawk
(74) *Attorney, Agent, or Firm*—Dykema Gossett PLLC

(57) ABSTRACT

A crutch-like mobility assist device includes a vertical support assembly, an underarm support mechanism, and a rotatable footer assembly, the rotatable footer assembly including an elongated ground-engaging foot pad, attachment members connected to the foot pad and having vertical posts, and an elongated connection member with openings through which the vertical posts extend. The connection member includes respective pairs of support blocks on opposite sides of the vertical posts with bores therethrough for shafts that also extend through the posts to enable the posts (and thus the foot pad) to laterally rotate around the shafts. The foot pads can come into parallel contact with the ground even when the vertical support to which it is connected is laterally oriented by the user. Torsion springs connected to the posts will return the posts to a central orientation relative to the connection member when the foot pad is lifted off the ground by the user.

8 Claims, 2 Drawing Sheets

U.S. PATENT DOCUMENTS

| | | | |
|---|---|---|---|
| 5,865,204 | A | 2/1999 | Bracy |
| 6,138,699 | A | 10/2000 | Su |
| 6,164,305 | A | 12/2000 | Herman |
| 6,374,841 | B1 | 4/2002 | Yamamoto et al. |
| 6,883,530 | B2 | 4/2005 | Kawakami |
| 7,047,990 | B2 | 5/2006 | Zambrano et al. |
| 2004/0107983 | A1 | 6/2004 | Liao |

* cited by examiner

CRUTCH-LIKE MOBILITY ASSIST DEVICE WITH ROTATABLE FOOTER ASSEMBLY

CROSS-REFERENCE TO RELATED APPLICATION

This application is based on U.S. Provisional Application No. 60/743,028, filed Dec. 13, 2005, the contents of which are hereby incorporated by reference and the priority of which is hereby claimed.

BACKGROUND OF INVENTION

1. Field of the Invention

The present invention relates to crutch-like mobility assist devices which can be used by injured and handicapped individuals to assist in their mobility by providing a ground or floor-engaging base that remains parallel to and flat on the ground or flooring surface as the user moves forward. The invention also relates to footer assemblies for such devices.

2. The Prior Art

Crutch-like mobility assist devices of the foregoing type are well known. See, for example, U.S. Pat. No. 5,640,986. Such devices employ footer assemblies that include foot pads for contact with a ground or flooring surface and attachment brackets that mount the foot pad to the lower end of a vertical support assembly having support rods interconnected by spaced connection members. However, such footer assemblies do not provide an ability for the foot pad to rotate laterally relative to the vertical support assembly, and thus if the vertical support assembly is extended laterally of the user, the foot pad will become angled relative to the ground flooring surface. This will reduce the effectiveness of the footer assembly to operate properly. Extending the vertical support assembly of a mobility assist device can be quite advantageous in providing a wide, and thus stable, support base for the user.

It is an object of this invention to provide a footer assembly for a crutch-like mobility assist device which can rotate so as to enable its foot pad to come into parallel contact with the ground or flooring surface beneath the user even when the vertical support assembly to which it is attached is angled by the user relative to the ground or flooring surface.

SUMMARY OF THE INVENTION

According to this invention a crutch-like mobility assist device includes an elongated footer assembly that includes a foot pad for contact with the ground or flooring surface, at least two T-shaped attachment members which are connected to the foot pad and which provide upwardly-extending posts, a U-shaped connection member which includes a floor having openings through which the posts extend, pairs of support blocks within the U-shaped channel on opposite sides of the posts, and pivot shafts which respectively extend between the pairs of support blocks and through bores in the respective posts to enable the posts and thus the foot pad attached thereto to rotate relative to the shafts. Damper pads can be positioned between the posts and side walls of the U-shaped connection member to cushion movement of the posts as they rotate around the shafts, and torsion springs can be positioned around the shafts on opposite sides of each post to bias the posts to a centered orientation within the connection member when the user lifts the footer pad off the ground or flooring surface.

A footer plate is advantageously positioned between the attachment members and the foot pad, and damper pads are advantageously position between each attachment member and the footer plate.

The invention will now be better understood by reference to the attached drawings, taken in conjunction with the following discussion.

DETAILED DESCRIPTION OF THE PREFERRED EMBODIMENT

Figure 1:
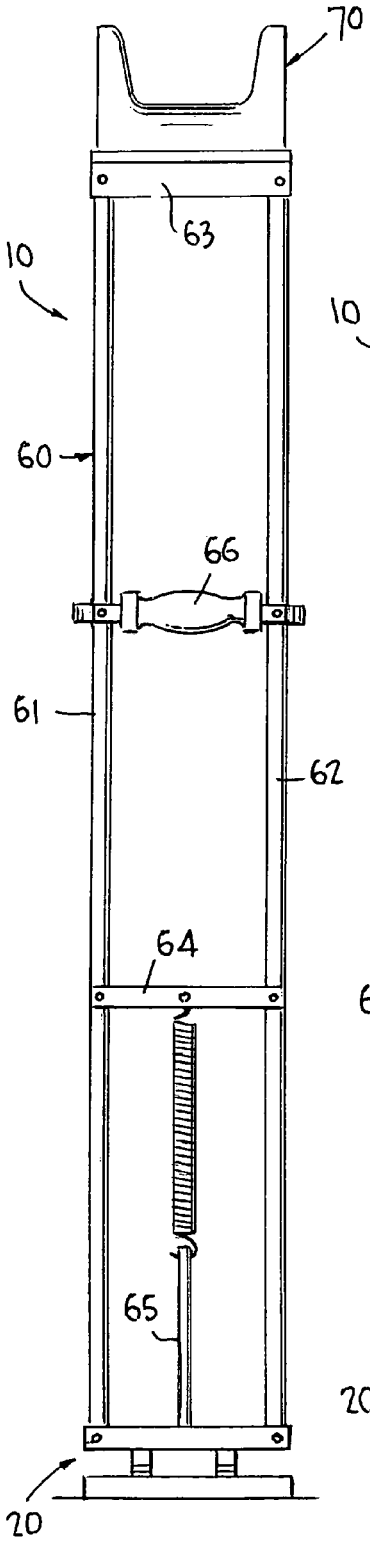
FIG. 1 shows a side elevational view of a crutch-like mobility assist device with rotatable footer assembly according to a preferred embodiment of the present invention.
Figure 2:
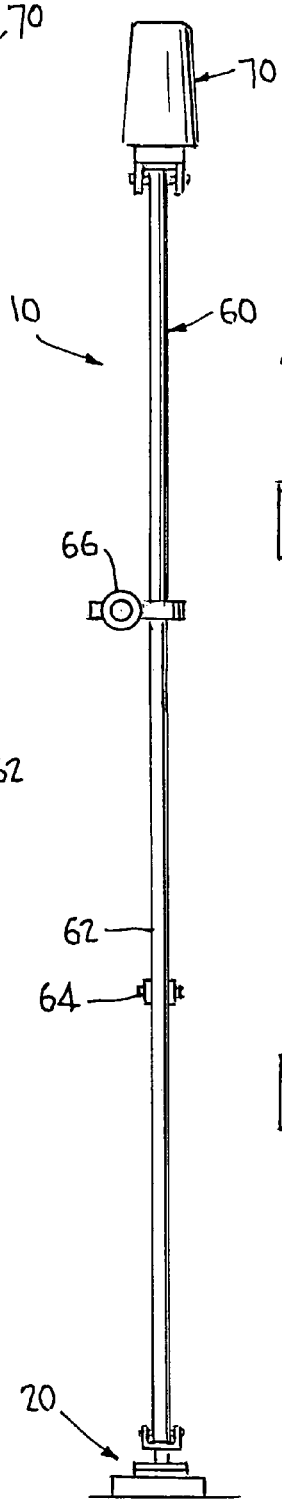
FIG. 2 is a rear elevational view thereof.
Figure 6:
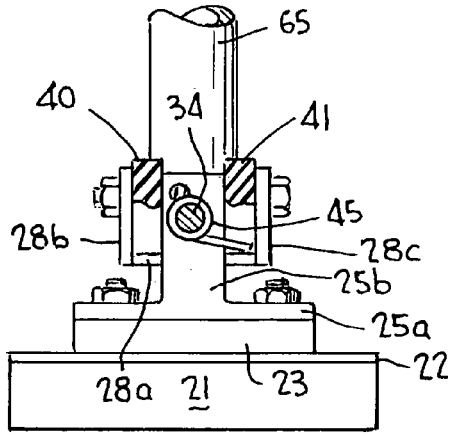
FIG. 6 is a cross-sectional view of the lower end of the mobility assist device as seen along line 6-6 in FIG. 5.

A preferred embodiment of a crutch-like mobility assist device with rotatable footer assembly according to the present invention is generally labeled 10 in FIGS. 1 and 2. It includes a rotatable footer assembly 20, a vertical support assembly 60, and an underarm support mechanism 70. The underarm support mechanism 70 can be constructed in accordance with our concurrently filed application Ser. No. 11/637,929, filed Dec. 13, 2006.

The vertical support assembly 60 includes vertical support rods 61 and 62 which are connected at their corresponding upper ends by upper connection member 63, at their corresponding lower ends by a connection member 26 of the footer assembly 20 (discussed below), and by an intermediate connection member 64 which is located above the connection member 28 about ⅓ the distance to the upper connection member 63. The connection members 63 and 64 have generally n-shaped cross-sections and are rotatingly connected near their opposite ends to rods 61 and 62 by rivets. Other connection means that enable relative rotation between the connection members and the rods can be used, such as pins, bolts, etc. A spring-rod device 65 is connected between the intermediate connection member 64 and the connection member 28. A hand grip 66 is rotatingly connected to rods 61 and 62 by rivets (pins or bolts could also be used) at a point above the intermediate connection member 64, the exact location being determined by the arm length of the intended user of the mobility assist device (custom fit).

The rotatable footer assembly 20 includes an elongated, generally rectangular foot pad 21, an elongated footer plate 22 positioned on the foot pad, and first and second T-block attachment members 25 and 26 longitudinally positioned on the footer plate by way of respective damper pads 23 and 24. These damper pads buffer impact of the footer pad 21 on a ground or flooring surface. T-block attachment member 25 includes base flanges **25*a* with vertical holes therethrough and a vertical post 25***b* with a horizontal bore therethrough. T-block attachment member 26 includes base flanges 26*a* with vertical holes therethrough and a vertical post 26*b* with a horizontal bore therethrough. Bolts 27 extend through the holes in the base flanges 25*a*, 26*a*, and through aligned holes in the damper pads 23, 24 and the footer plate 22, and into the foot pad 21 to connect these elements together.

The vertical posts 25*b*, 26*b* extend upwardly through openings in the floor 28*a* of U-shaped connection member 28 that is rotatable attached at its opposite ends to the lower ends of rods 61 and 62 by bolts (pins or rivets could also be used). The lower end of the spring-rod device 65 is connected to the center point of floor 28*a* and between the openings for posts 25*b* and 26*b*. The U-shaped connection member includes side walls 28*b* and 28*c*. Fixedly mounted within the U-shaped connection member 26 are pairs of support blocks 30, 31 and 32, 33, with support blocks 30 and 31 being located on opposite sides of the vertical post 25*b* and support blocks 32 and 33 being located on opposite sides of the vertical post 26*b*. The support blocks provide bores therethrough that are aligned with the horizontal bores in the vertical posts. A pivot shaft 34 extends through the bore in the vertical post 25*b* and the aligned bores in the support blocks 30 and 31, and a pivot shaft 35 extends through the bore in the vertical post 26*b* and the aligned bores in the support blocks 32 and 33. These shafts are longitudinally fixed in position and coaxially aligned to enable the posts, and thus the foot pad 21, to be rotated laterally about a longitudinal axis defined by the shafts 34 and 35.

Damper pads 40 and 41 are positioned between the vertical post 25*b* and the side walls 28*b* and 28*c* of the connection member 28, and damper pads 42 and 43 are positioned between the vertical post 26*b* and the side walls 28*b* and 28*c*, to cushion movement of the posts towards the side walls. Torsion springs 45 and 46 are respectively positioned around the shaft 34 on opposite sides of the post 25*b*, one end of each being connected to the post and the other abutting the floor 28*a*, to apply opposing bias to the post 25*b* and move it back to a centered orientation within the U-shaped connection member 28 after rotational movement around the shaft. Torsion springs 47 and 48 are similarly positioned around shaft 35 to similarly bias the post 26*b*.

Figure 7:
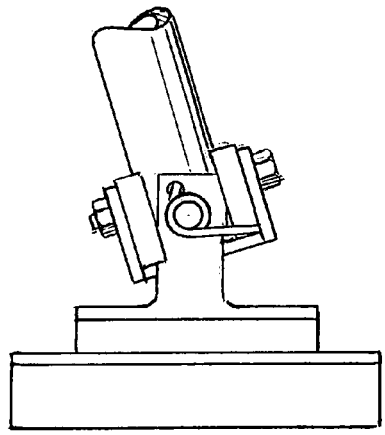
FIG. 7 is a view similar to FIG. 6 but wherein the rods of the vertical support assembly extend at a lateral angle relative to the footer assembly.
Figure 3:
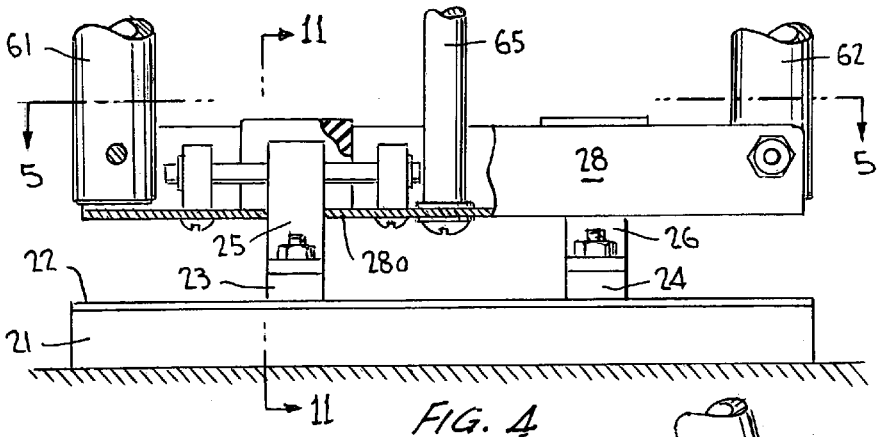
FIG. 3 is an enlarged view, partly in section, of the lower end of the mobility assist device of FIG. 1 and showing the rotatable footer assembly.
Figure 4:
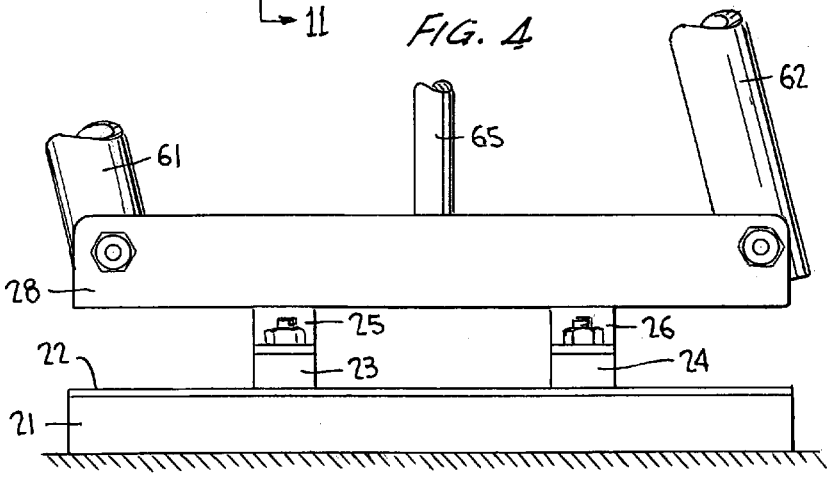
FIG. 4 is a view similar to FIG. 3 but wherein the rods of the vertical support assembly are pivoted in a longitudinal direction relative to the footer assembly.
Figure 5:
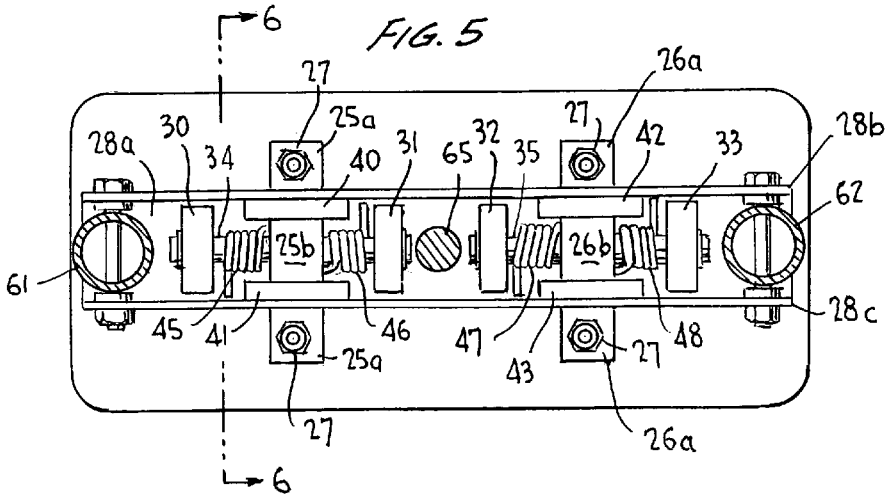
FIG. 5 is a cross-sectional view of the lower end of the mobility assist device as seen along line 5-5 in FIG. 3.

The rotation of posts 25*b* and 26*b* around pivot pins 34 and 35 enables the foot pad 21 to be in full contact with the ground or flooring surface even when the vertical support assembly 60 is laterally oriented (see FIG. 7).

Although a detailed description of a preferred embodiment of the inventive crutch-like mobility assist device with rotatable footer assembly has been provided, modifications can be made therein and still fall within the scope of the appended claims. For example, more that two attachment members could be used, with accompanying modifications in the U-shaped connection member 28. Further, the two pivot shafts 34 and 35 could be portions of a single pivot shaft which extends through suitable a hole(s) in the spring-rod device 65. The attachment members 25 and 26 could be portions of a single attachment member.

We claim:

1. A rotatable footer assembly for a crutch-like mobility assist device which comprises:

an elongated foot pad for contact with ground or a flooring surface, first and second attachment members longitudinally positioned on said foot pad, said first and second attachment members including respective first and second posts which vertically extend away from said foot pad and respectively include horizontal bores therethrough, an elongated connection member which includes a floor having two holes therein through which said first and second posts respectively extend, first and second support blocks on opposite sides of said first post and having bores therethrough aligned within the bore in said first post, and third and fourth support blocks on opposite sides of said second post and having bore therethrough aligned with the bores in said second post, and first and second shafts extending through the bores in said first and second posts respectively and the respective bores in the first and second support blocks and the third and fourth support block, to enable the posts to rotate relative to the connection member about the shafts.

2. The rotatable footer assembly as defined in claim 1, including torsion springs positioned around said first and second shafts on opposite sides of said first and second posts and connected to said posts to apply opposite bias to said posts and bias said posts to a centered positioned relative to the connection member.

3. The rotatable footer assembly as defined in claim 1, wherein said connection member has a generally U-shaped cross section with side walls, and including damper pads located between each of said first and second posts and said side walls to cushion rotation of said posts relative to said side walls.

4. The rotatable footer assembly as defined in claim 1, including a footer plate between said first and second attachment members and said foot pad.

5. The rotatable footer assembly as defined in claim 4, wherein each of said first and second attachment members comprises a T-block having a base flange, and including respective damper pads between said first and second attachment members and said footer plate.

6. The rotatable footer assembly as defined in claim 5, including bolts which extend through aligned holes in each base flange, the footer plate and into the footer pad, and which extend into said foot pad.

7. A crutch-like mobility assist device which comprises:

a vertical support assembly having two support rods and an upper connection member, an underarm support mechanism attached to said upper connection member, and a footer assembly attached to a lower end of said vertical support assembly, said footer assembly comprising an elongated foot pad for contact with a ground or flooring surface, a connection member defining a longitudinal axis, and a spring-loaded attachment means connecting the foot pad to said connection member and enabling the food pad to be rotatable around said longitudinal axis, wherein said vertical support assembly includes two rods and said connection member of said footer assembly is rotatingly connected at opposite ends thereof to lower ends of said respective rods, wherein said connection member of said footer assembly is generally U-shaped and said attachment means comprises posts which extend upwardly through openings in a floor of said U-shaped member, and including at least one pivot shaft mounted in said U-shaped member and said posts are rotatingly mounted on said at least one pivot shaft.

8. The crutch-like mobility assist device according to claim 7, including torsion springs connected to said posts bias said post into a center orientation relative to said U-shaped connection member.

* * * * *